United States Patent [19]

Elliott et al.

[11] 4,315,737

[45] Feb. 16, 1982

[54] BASE FOR A KILN CAR

[75] Inventors: John Elliott; Malcolm G. Bell; William J. Lovatt, all of Stoke on Trent, England

[73] Assignee: Acme Marls Limited, Hanley, England

[21] Appl. No.: 176,295

[22] Filed: Aug. 8, 1980

[30] Foreign Application Priority Data

Aug. 14, 1979 [GB] United Kingdom ..... 28274/79

[51] Int. Cl.[3] ..... F27D 3/12; F27D 5/00

[52] U.S. Cl. ..... 432/241; 432/258

[58] Field of Search ..... 432/241, 258

[56] References Cited

U.S. PATENT DOCUMENTS

| | | | |
|---|---|---|---|
| 1,521,216 | 12/1924 | Dressler | 25/142 |
| 1,587,210 | 6/1926 | Beecher et al. | 432/241 |
| 1,694,749 | 12/1928 | Moore et al. | 25/142 |
| 1,739,176 | 12/1929 | Morris et al. | 25/142 |
| 2,629,917 | 3/1953 | Lovatt | 432/241 |
| 2,879,577 | 3/1959 | Milburn | 432/241 |
| 3,988,107 | 10/1976 | Koch | 432/258 |
| 4,045,167 | 8/1977 | Elliott | 432/241 |

FOREIGN PATENT DOCUMENTS

| | | | |
|---|---|---|---|
| 2655316 | 8/1978 | Fed. Rep. of Germany | 432/241 |
| 135931 | 6/1979 | Fed. Rep. of Germany | 432/241 |
| 1525292 | 4/1967 | France . | |

*Primary Examiner*—John J. Camby

*Attorney, Agent, or Firm*—Merriam, Marshall & Bicknell

[57] ABSTRACT

A base for a kiln car for firing ceramic ware is constructed so as to have low thermal mass combined with adequate load-supporting strength. It comprises upright load-supporting pillars (16) made of stacked elements (17) and having continuous vertical grooves (20). Peripheral thin ceramic walls (19) slot into the grooves (20), to define central compartments (22) subsequently filled with insulating material, e.g. ceramic fiber. Horizontal bats (18), trapped between elements (17) project at the periphery of the base to form a radiant heat seal with adjacent kiln car bases and the kiln walls.

11 Claims, 3 Drawing Figures

BASE FOR A KILN CAR

BACKGROUND OF THE INVENTION

1. Field of the Invention

This invention relates to a base for a kiln car for use in the firing of ceramic ware.

2. Description of the Prior Art

Such kiln cars conventionally comprise a wheeled trolley made of metal, a heat resistant base mounted on the trolley, an open sided region known as a flue disposed above the base and a refractory superstructure to support the ware. This invention is concerned with the construction of the heat resistant base.

A conventional such base is made of fire bricks cemented together into a solid mass. This construction has been favoured in the past because the fire bricks are adequate insulators to prevent heat generated in the upper part of the kiln, particularly the flue, from having a harmful effect on the metal trolley but also because the fire bricks can carry the quite considerable load of the super structure and the ware loaded on it.

Unfortunately, alongside these advantages, the conventional arrangement has a grave disadvantage in that the base has a very high thermal mass and hence absorbs a considerable amount of the heat generated in the kiln which is therefore not operated as efficiently as it could be.

It has previously been proposed to produce a low thermal mass kiln car base but difficulties have been encountered and expense has been involved in the construction of such a base because of the need for a peripheral heat seal around each kiln car to prevent radiant heat from the burners passing down to the wheeled metal trolley. A solid fire brick base is provided with a step at one end and an overhang at the other end so that, when a number of kiln cars are moved into a kiln, the step and overhang of the adjacent cars overlap and radiant heat cannot be directed downwardly through the gap. Similarly, each side edge of the kiln car base has a projection extending outwardly along its entire length and this projection is received by a groove extending along the side wall of the kiln to form a lateral heat seal between the kiln car and the kiln walls.

It is not necessary to form an air tight seal because heat transfer by conduction through air is negligible and, since the hottest region of the kiln is the flue which is disposed above the base, convection also pays a negligible part in heat transfer. All that is required is a barrier against the penetration of radiant heat from the flue to the wheeled metal trolley, in other words to provide a light-tight seal.

It has previously been proposed to form a low thermal mass base for a kiln car but there has been a problem in providing a heat seal between one car and the next and between the sides of the car and the kiln walls. This has necessitated such extreme measures as casting a complete peripheral surround of a mouldable concrete material which is very skilled work and which is expensive to carry out. Any damage to part of this concrete surrounding structure means that the entire structure has to be replaced and it does have a fairly considerable thermal mass.

SUMMARY OF THE INVENTION

It is an object of the present invention to provide a new or improved form of low thermal mass base for a kiln car.

According to the invention there is provided a base for a kiln car comprising a plurality of upright pillars intended to be supported on a wheeled metal trolley, each pillar comprising a plurality of vertically stacked pillar elements of load bearing, heat resistant material, each pillar having one or more vertically extending locating means; a plurality of ceramic baffle walls located upright by said locating means between at least the peripherally disposed pillars of said plurality to define one or more central compartments; and one or more horizontally disposed ceramic bats disposed between pillar elements of said pillars and extending peripherally outwardly of said pillars to provide a heat seal.

The or each central compartment may be filled with a low thermal mass heat insulating material, for example ceramic fibre, vermiculite or perlite.

The pillar elements may have inter-engageable formations to locate them against lateral relative displacement. Additionally, the ceramic bats providing the heat seal may have formations inter-engageable with those of the pillar elements between which they are located.

The locating means on the pillar elements may comprise grooves which may extend continuously throughout the entire length of the pillars. The grooves may receive the vertically extending edges of the baffle walls.

The horizontally disposed ceramic bats may extend inwardly of the pillars, in addition to extending outwardly thereof to provide the heat seal and may occupy the entire area, viewed in plan, of the kiln car base. Alternatively, the ceramic bats may be localised around the periphery of the base.

BRIEF DESCRIPTION OF THE DRAWINGS

The invention will now be described in more detail by way of example only with reference to the accompanying drawings in which.

DETAILED DESCRIPTION OF THE PREFERRED EMBODIMENT

Figure 1:
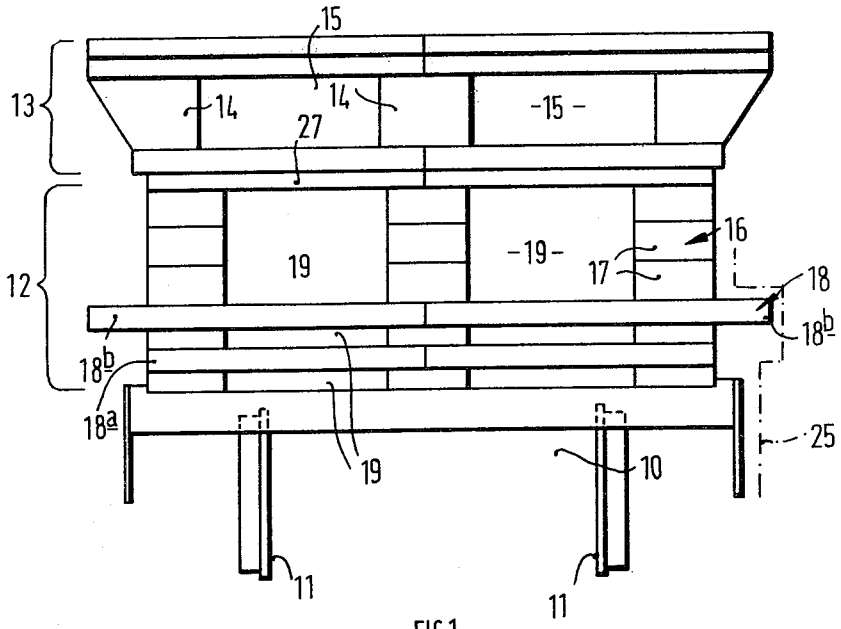
FIG. 1 is an end elevational view of a kiln car embodying the invention, with the position of kiln walls being indicated in chain dotted lines.
Figure 2:
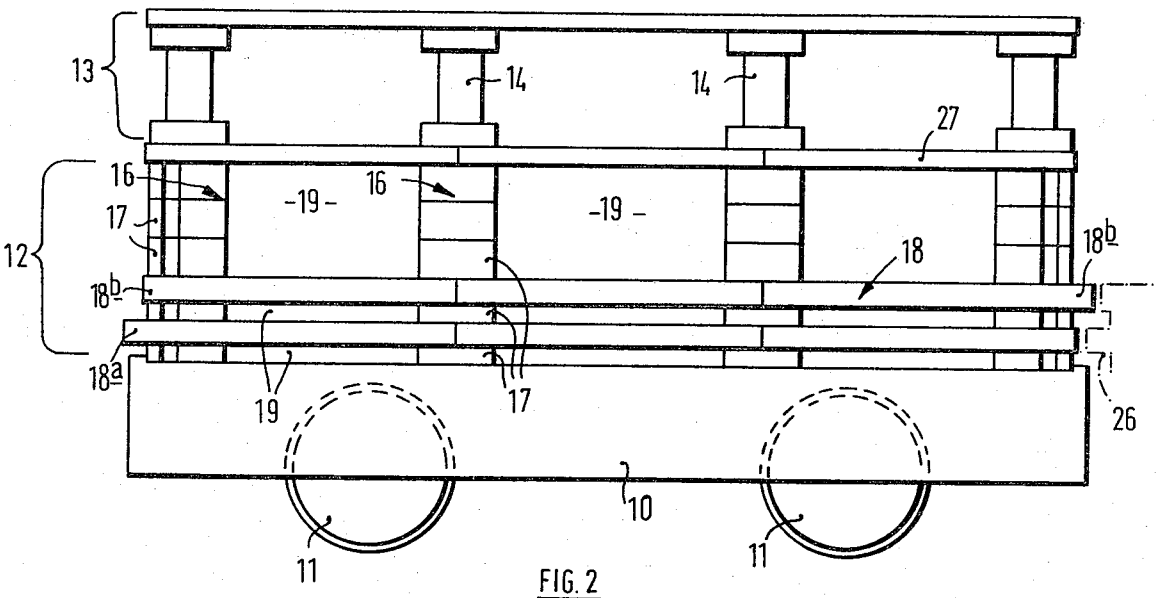
FIG. 2 is a side elevational view of the kiln car, with the position of an adjacent similar kiln car indicated in chain dotted lines.

Referring firstly to FIGS. 1 and 2 of the drawings, the lower part of a kiln car is illustrated. This comprises a metal trolley 10 having wheels 11, adapted to run on tracks (not shown) provided in a tunnel kiln.

Mounted on the trolley 10 is a base 12, the vertical extent of which is indicated by the bracket. It is with this region of the kiln car that the improvements of the present invention are concerned.

Above the base 12, there is a region 13 known as the flue, which is the hottest part of the kiln car in use, since it is into this region, immediately below the ware to be fired, that the burners of the kiln are directed. The flue 13 illustrated is conventional. The kiln car super structure and ware are not shown in the drawings but may be of any conventional type.

The flue 13 will be seen to include a number of uprights 14 which provide mechanical support for the load comprising the weight of the super structure and the ware. Openings 15 are to be found between the uprights 14, to form an air space into which the heating means, for example, gas or oil burners, of the kiln are directed.

The base 12 embodying the invention includes a plurality of pillars generally indicated at 16 which are disposed below the uprights 14, so as to take the vertical load of the ware and super structure. The pillars 16 are made of pillar elements 17, shown in more detail in FIG. 3. The pillar elements are stacked vertically and may include inter-engaging formations such as projections and recesses (not shown) on the upper and lower faces so as to enable the pillar elements to be interlocked against relative lateral movement. The pillar elements are not cemented together and hence can be separated vertically.

Each pillar element is made of a ceramic material of fairly high compressive strength so as to support the necessary loads. Although the ceramic material may also have adequate thermal insulation properties, it is envisaged that a gasket of ceramic fibre may be used between each pillar element and its neighbours, in order to reduce the tendency for the pillar elements to form conductive paths between the flue 13 and the trolley 10.

A plurality of ceramic bats 18 are provided in the lower region of the base. These ceramic bats 18 are located between upper and lower pillar elements 17, to which they may be keyed by interfitting formations (not shown) on the bats and the pillar elements.

In the embodiment of the invention shown in the drawings, the bats 18 extend throughout the entire plan area of the base and also extend peripherally outwardly in the manner to be described later. However, this need not necessarily be the case, provided that the ceramic bats are disposed at least in a region localised around the periphery of the base.

So far, the parts described have formed a load supporting framework for the base, fulfilling one of the two criteria for a kiln car base.

The other criterion is to provide thermal insulation between the extremely hot region of the flue 13 and the trolley 10. In order to achieve this, a low thermal mass heat insulating material is interposed between the pillars 16. The thermally insulating material (not shown) may comprise for example a ceramic fibre, perlite or vermiculite. In order to contain the insulating material, a peripheral wall and possibly some internally dividing walls are provided, located by vertically extending locating means on the pillars. The insulating material is introduced into the compartment or compartments defined by these walls and a further layer of bats is used to cover and completely enclose the ceramic fibre or other material to avoid health hazards and damage to the ceramic ware being fired, due to loose fibres or powder.

Figure 3:
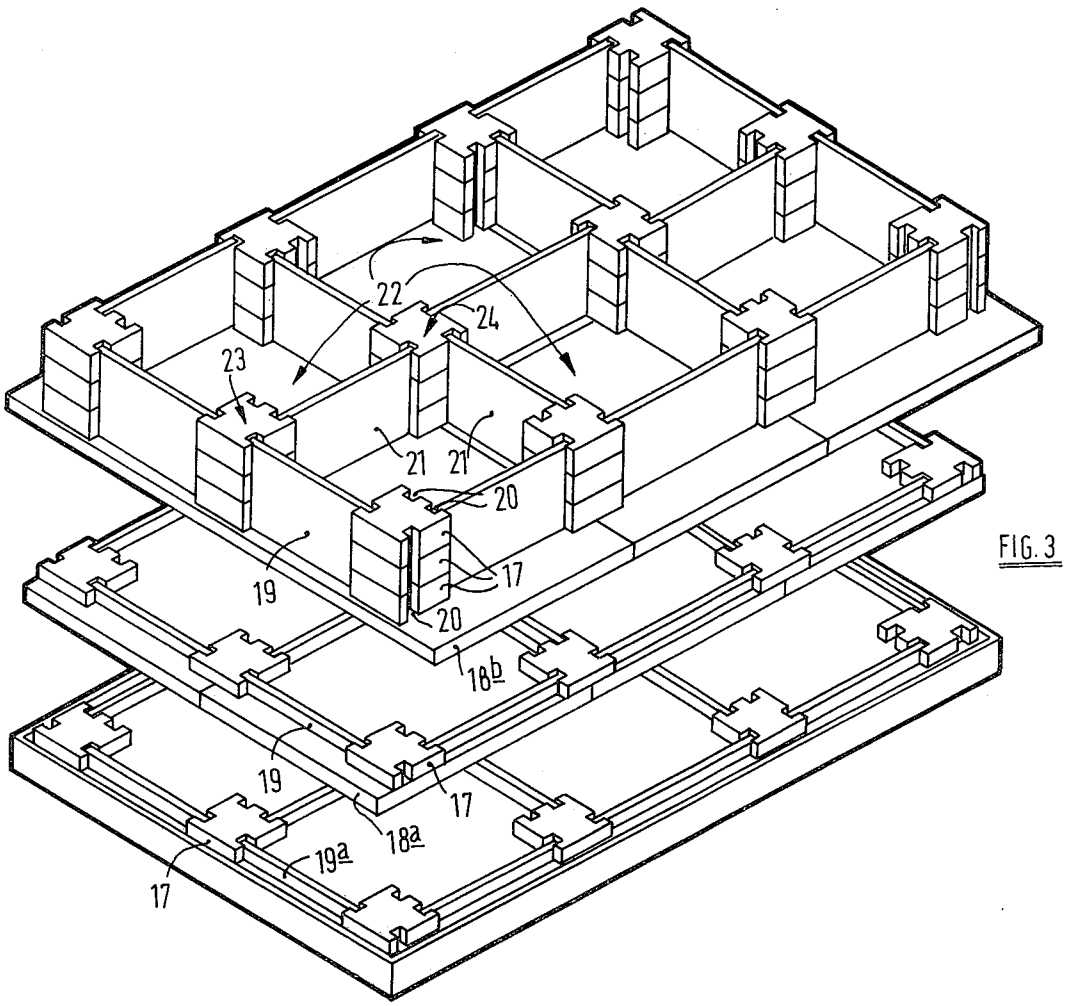
FIG. 3 is an exploded perspective view of a kiln car base embodying the invention.

The arrangement can be seen in more detail in FIG. 3 of the drawings. The peripheral walls are indicated at 19 and will be seen to comprise flat rectangular sheets of heat resistant ceramic material, similar to the material of the bats. The walls 19 are not load bearing, since the load is taken on the pillars 16 and so the walls 19 need not be of particularly strong or thick material. The pillar elements 17 are provided with vertically extending locating means in the form of grooves 20, which are of a suitable size to receive the walls 19 as a loose sliding fit.

In FIG. 3 of the drawings, it will be seen that additional internal dividing walls 21 are also provided, to divide the internal space within the peripheral walls 19 into a plurality of compartments 22, to receive the low thermal mass insulating material.

The arrangement of the horizontally disposed ceramic bats 18 will now be described in more detail. As referred to above, the bats 18 are located between adjacent pillar elements 17 and may have inter-engaging formations to hold them in correct position relative to the pillars. Firstly, the lowermost bat, which is indicated at 18*a*, is placed on the lowermost set of pillar elements and is arranged so as to project outside the main plan area of the base in a forward direction, relative to the travel of the kiln car. The projecting portion 18*a* can be seen in FIG. 2 at the left hand side. It will be seen that part 19*a* of the peripheral wall is disposed between the lowermost pillar elements 17, below the level of the bat 18*a*.

After the lowermost layer of bats 18*a* has been positioned, a further layer of pillar elements 17 is added and further small portions of peripheral wall 19 are slotted into the grooves 20. A further layer of horizontal ceramic bats 18*b* is then added. As will be seen from FIG. 2 of the drawings, the layer of bats 18*b* does not project at the forward end of the base but at the rearward end shown at the right hand side of FIG. 2. Additionally, the layer 18*b* projects at both side edges of the kiln car, as seen in FIG. 1.

The remainder of the base is built up from more pillar elements 17 supporting peripheral walls 19 and optionally internal dividing walls 21 as shown. It will be seen that the pillar elements are of either of two different types, having different plan shapes. Around the periphery of the base, the type of pillar element used has the plan view indicated by the arrow 23 in FIG. 3; at the centre region of the base, the plan view is as indicated at 24. By suitably rotating the elements, the entire peripheral wall and internal dividing wall structure can be built up using only these two types of pillar element and using upright walls of identical lengths.

The peripherally projecting parts of the ceramic bats 18 form a heat seal which prevents or minimises the passage of radiant heat from the flue 13 downwardly to the trolley 10 of the kiln car. In FIG. 1, which shows the kiln car in end elevation, the position of the kiln wall is indicated in chain dotted lines at 25. Although the details of the profile may vary from one kiln to another, this general type of profile is used conventionally and no modification of the kiln wall is likely to be necessary to take the kiln car base of the present invention.

It will be seen that part of the kiln wall projects inwardly and that the peripherally projecting portion of the upper layer of ceramic bats 18*b* is received in a recess below this projecting part of the kiln wall so as to form a light-tight barrier, preventing radiant heat from being directed downwardly between the kiln walls and the side of the kiln car, with possible harmful effects on the trolley 10.

Referring to FIG. 2 of the drawings, it will be seen that the kiln car illustrated in full abuts another kiln car at the right hand side of the drawing. The outline of the forward end of this other kiln car is shown at 26 in the drawings in chain dotted lines, and corresponds exactly to the profile of the forward end of the kiln car shown in full. It will be seen that the upper layer of bats 18*b* projects at the rear of the car and the lower layer 18*a* projects at the front of the next adjacent car, so that light, and hence heat radiation, cannot penetrate downwardly between the kiln cars when they are abutted end to end, as they would be in normal use.

It will be seen that a small gap exists between the adjacent kiln car bases and also between each base and the wall of the kiln, to prevent or reduce damage and abrasion of the bats 18. It is not necessary to form an airtight seal around the base of the kiln car because any heating of the trolley 10 is likely to be due almost exclusively to penetration of radiant heat from the flue 13 since conduction and convection effects are minimal for the reasons referred to above.

The embodiment of the invention described above provides a kiln car base which has a very low thermal mass compared with the conventional solid fire brick base, which improves heat insulation between the flue and the metal trolley, owing to the superior thermal insulating properties of the lightweight insulating materials used, and which additionally has means for forming the heat seal with the walls of the kiln and with adjacent kiln car bases. The base is capable of carrying the usual load due to the weight of the superstructure and ware.

However, it is not a particularly skilled operation to assemble the base. The components are relatively small and lightweight and only a few different types of component are required, so that the whole assembly operation can be carried out very readily. Additionally, the components for forming a base can be packed for freighting purposes into a relatively small volume and weigh less than the conventional fire bricks used for a conventional base. The low thermal mass insulating material can be of any suitable type such as ceramic fibres, vermiculite or perlite. Some suitable material is readily available in most countries.

The components can be assembled without the use of cement and there is no moulding operation or the like required. All that is required is for the pillar elements, bats and walls to be slotted or connected together, for the central part (which may be in the form of compartments) to be filled with insulating material of a suitable type and for the top of the base to be closed off by top bats 27, defining the under part of the flue 13 and completely enclosing the lightweight thermal insulating material. The operatives constructing the base are therefore not subjected to possible health hazard from fibres or particles of insulating material except during the filling of the base, when precautionary measures such as the use of breathing masks should be taken. Once the base has been assembled, the insulating material is inaccessible and cannot give rise to health problems or to damage by dust contamination or fibre contamination of the ware.

The thermal mass of the entire base structure is substantially reduced compared with conventional fire brick bases and even compared with the previously proposed lightweight bases incorporating surrounding heat seals made of settable concrete.

Although the invention has been described in relation to an embodiment in which the bats 18 occupy the entire plan area of the base, and project peripherally as described, it is possible to use ceramic bats which occupy only a peripheral region of the base and project outwardly to form the heat seal, the central region of the base being completely open between the flue and the trolley 10 and merely being filled with low thermal mass insulating material. Of course, the pillars are still required to support the load of the super structure but it will be appreciated that it is not necessary for the central pillars to be made of pillar elements stacked one on another as shown, if the horizontal ceramic bats do not penetrate into the centre of the base.

In a further modification (not shown) the peripheral region of the ceramic bats 18 is grooved to receive and locate the peripheral walls 19. This modification may be made whether the bats 18 extend into the centre of the base or not.

We claim:

1. A kiln car base adapted to be directly mounted on a wheeled metal trolley, comprising a plurality of load bearing, thermally insulating upright pillars, each pillar comprising a plurality of vertically stacked pillar elements of load bearing, thermally insulating ceramic material, each pillar having one or more vertically extending locating means; a plurality of ceramic baffle walls engaging and retained in upright positions by said locating means between at least the peripherally disposed ones of said pillars to define one or more central compartments; one or more horizontally disposed ceramic bats disposed between pillar elements of said pillars and having portions thereof extending peripherally outwardly of said pillars to provide a heat seal, and a low thermal mass insulating material in the or each central compartment.

2. A base according to claim 1 wherein the locating means on the pillar elements comprise grooves extending continuously throughout the entire length of the pillars to receive vertically extending edges of the upright baffle walls.

3. A base according to claim 1 wherein the insulating material comprises ceramic fibre.

4. A base according to claim 1 wherein the insulating material comprises vermiculite.

5. A base according to claim 1 wherein the insulating material comprises pearlite.

6. A base according to claim 1 wherein the pillar elements have inter-engageable formations to locate them against lateral relative displacement.

7. A base according to claim 6 wherein the ceramic bats providing the heat seal have formations inter-engageable with those of the pillar elements between which they are located.

8. A base according to claim 1 wherein the ceramic bats extend inwardly of the pillars, in addition to extending outwardly thereof to provide the heat seal.

9. A base according to claim 8 wherein the ceramic bats occupy the entire plan area of the base.

10. A base according to claim 1 wherein a plurality of generally horizontally disposed top bats rest on said pillars and cover the or each central compartment to enclose said heat insulating material.

11. A base according to claim 1 wherein said base is adapted for use in a kiln car having forward and rearward ends relative to the direction of travel of said car, a vertically spaced pair of said horizontally disposed bats are disposed between said pillar elements, each bat of said vertically spaced pair has forwardly and rearwardly projecting end portions, and said forwardly and rearwardly projecting end portions are oppositely forwardly and rearwardly staggered relative to the direction of travel of said car, whereby the forwardly and rearwardly projecting end portions at the forward and rearward ends of said kiln car are adapted to interfit with the projecting end portions on adjacent ones of said kiln cars to provide said heat seal.

* * * * *